United States Patent [19]

Reams et al.

[11] 4,077,215

[45] Mar. 7, 1978

[54] COMPACT CERAMIC RECUPERATOR PREHEATER FOR STIRLING ENGINE

[75] Inventors: Lowell A. Reams, Plymouth; Thomas F. Dunlap, Riverview; Robert K. Fenzan, Livonia, all of Mich.

[73] Assignee: Ford Motor Company, Dearborn, Mich.

[21] Appl. No.: 673,848

[22] Filed: Apr. 5, 1976

[51] Int. Cl.[2] ..... F02G 1/04

[52] U.S. Cl. ..... 60/517; 165/52; 165/66; 165/165

[58] Field of Search ..... 165/52, 66, 125, 165, 165/166; 60/517, 526, 39.51; 123/122 D

[56] References Cited

U.S. PATENT DOCUMENTS

| | | | |
|---|---|---|---|
| 3,717,993 | 2/1973 | Potter | 165/52 X |
| 3,889,744 | 6/1975 | Hill et al. | 165/165 X |
| 3,898,841 | 8/1975 | Kanzler et al. | 60/525 |
| 3,942,324 | 3/1976 | Johansson et al. | 60/517 |

FOREIGN PATENT DOCUMENTS

| | | | |
|---|---|---|---|
| 2,328,792 | 7/1972 | Germany | 60/517 |

*Primary Examiner*—Allen M. Ostrager
*Attorney, Agent, or Firm*—Joseph W. Malleck; Olin B. Johnson

[57] ABSTRACT

A Stirling engine adapted for automotive propulsion is disclosed using an improved preheater construction in the external heating circuit.The preheater construction is comprised of discrete cubicle modules arranged annularly about the engine burner with their inner faces in contiguous edge contact to define a close cylindrical space. The modules are totally ceramic with alternating orientation of finned ceramic wall fused together to define a cross-flow matrix. Static seal strips of woven ceramic material encased in a folded metal foil strip are retained against all of the edges of each module to facilitate cross-flow fluid connections.

1 Claim, 5 Drawing Figures

1a.
1b.
1.

COMPACT CERAMIC RECUPERATOR PREHEATER FOR STIRLING ENGINE

BACKGROUND OF THE INVENTION

The Stirling engine was originally conceived as long ago as 1816 by Rev. Stirling. During the middle of the 19th. Century, commercial applications of this hot gas engine were devised to provide rotary power to mills; these were fixed power plants. The Stirling engine was ignored thereafter until the middle of the 20th. Century because of the usefulness and popularity of the internal combustion engine. Not until very recently has the Stirling engine been visualized as a power plant to motorize moving vehicles. Converting a Stirling engine to automotive use presents many formidable problems due to reduced weight, size, energy conservation, cost and reliability limitations that are placed upon it.

One of these problems, energy conservation (engine efficiency), has stimulated the introduction of several modifications to make the Stirling engine suitable for automotive use. The Stirling engine employs a continuously operating external heating circuit which tends to waste considerable energy via exhaust gases released to atmosphere. For fixed power plants of the Stirling type, heavy steel heat exchangers were previously devised to return a proportion of the exhaust heat energy to the inducted air to facilitate combustion. Upon conversion to automotive use, the heavy steel heat exchangers were replaced by rotary ceramic preheaters which earlier had found utility in gas turbine engine applications. The rotary preheater functioned to expose hot gases through a crescent shaped opening (a one-half circle) to a rotating ceramic wheel, and separately exposed inducted air to the heated wheel at an independent crescent shaped opening.

Although the new art of making uni-directional ceramic heat exchanger cores was most welcome, certain attendant problems were not welcome, such as cost of the crescent shaped seals, the energy loss and noise from the motor drive, the decrease of reliability due to mechanical stress placed upon the fragile ceramic core by dynamic rubbing seal contact, and the lack of a uniform heat flux into the heater tube array due to the non-uniform air flow entering the combustor from the preheater.

SUMMARY OF THE INVENTION

The primary object of this invention is to provide a modified preheater construction for a Stirling engine useful in automotive applications, the improved preheater construction being capable of increasing engine efficiency and decreasing energy losses of the external heat circuit.

Another object of this invention is to provide a Stirling engine having an improved external heating circuit which is effective to increase heat transfer to the closed cycle working fluid circuit and provide a more uniform air flow into the combustor.

Yet still another object of this invention is to provide an improved preheater construction for an automotive type Stirling engine which (a) reduces the cost of manufacture, (b) facilitates a low pressure external heating circuit having less pressure drop through the external circuit, and (c) provides a more durable preheater construction which eliminates mechanical stresses and noise resulting from dynamic rubbing seals.

Specific features pursuant to the above objects comprise (a) The construction of a crossflow ceramic preheater having a plurality of ceramic plys each with rows of fins extending from said ply outwardly to one side thereof, said plys are sandwiched together in alternating orientation so as to define a crossflow characteristic; the fin height, fin pitch and ply thickness are each controlled to define an optimum porosity for said heat exchange matrix and to reduce the cost of manufacture; (b) Economical ceramic seals of a static type are employed at predetermined locations about the crossflow ceramic matrix; (c) The crossflow ceramic heat exchanger is arranged annularly about the burner unit and heater tube array of the Stirling engine so as to provide a uniform circumferential distribution of heat exchange thereabout; (d) The improved preheater may be subdivided into removable modules, each module having a simplified rectangular or cubical figuration, the modules being arranged in an annular alignment defining a closed space with their inner faces.

SUMMARY OF THE DRAWINGS

FIG. 1*a* is an enlarged sectional view of a portion of the matrix 14;

FIG. 1*b* is an enlarged sectional view through a seal strip and adjacent mating matrix.

DETAILED DESCRIPTION

Figure 1:
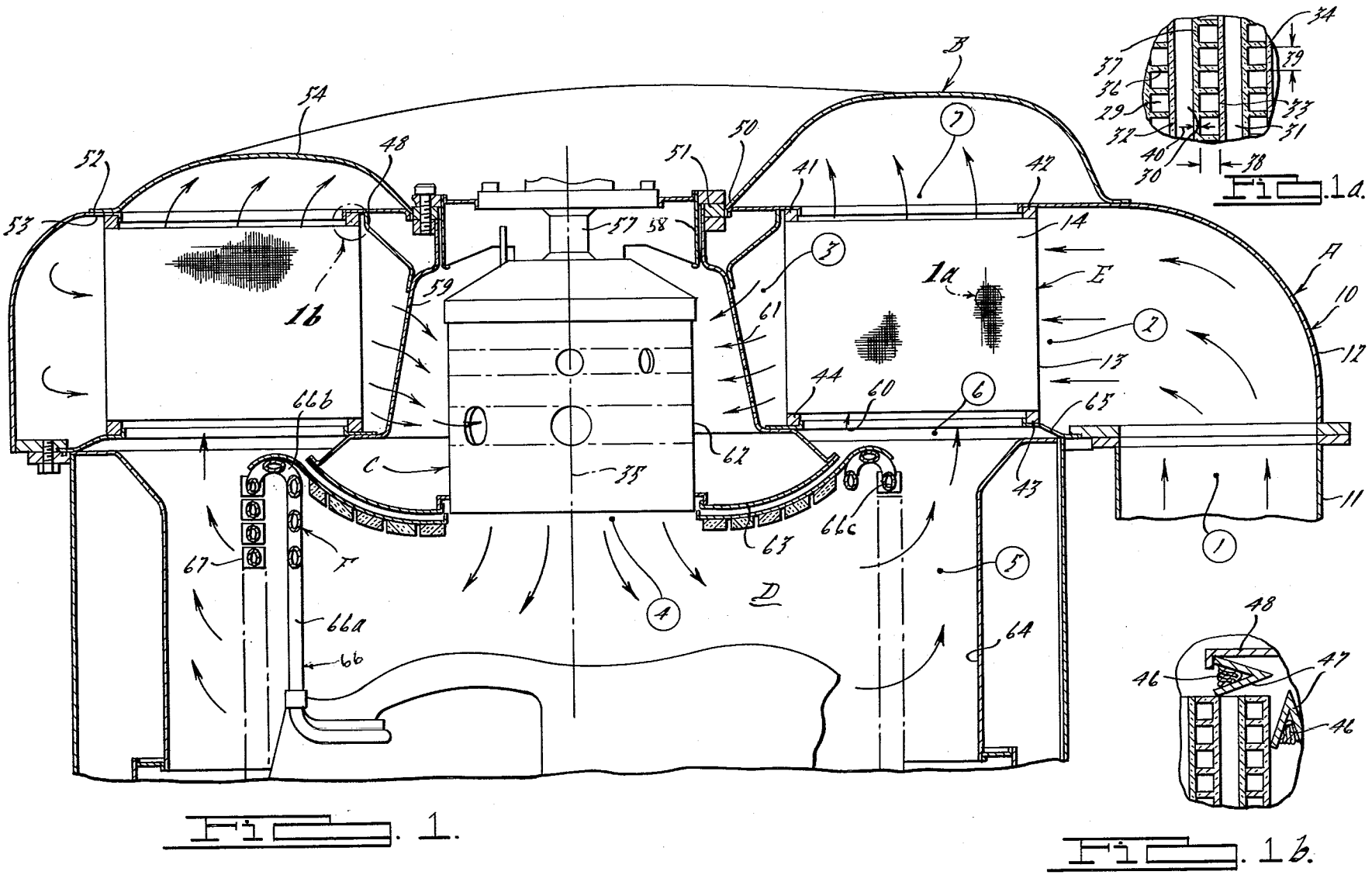
FIG. 1 is an enlarged fragmentary sectional view of the external heating circuit for a Stirling engine (taken along line 1-1 of FIG. 2), said assembly employing an improved preheater construction according to this invention.
Figure 2:
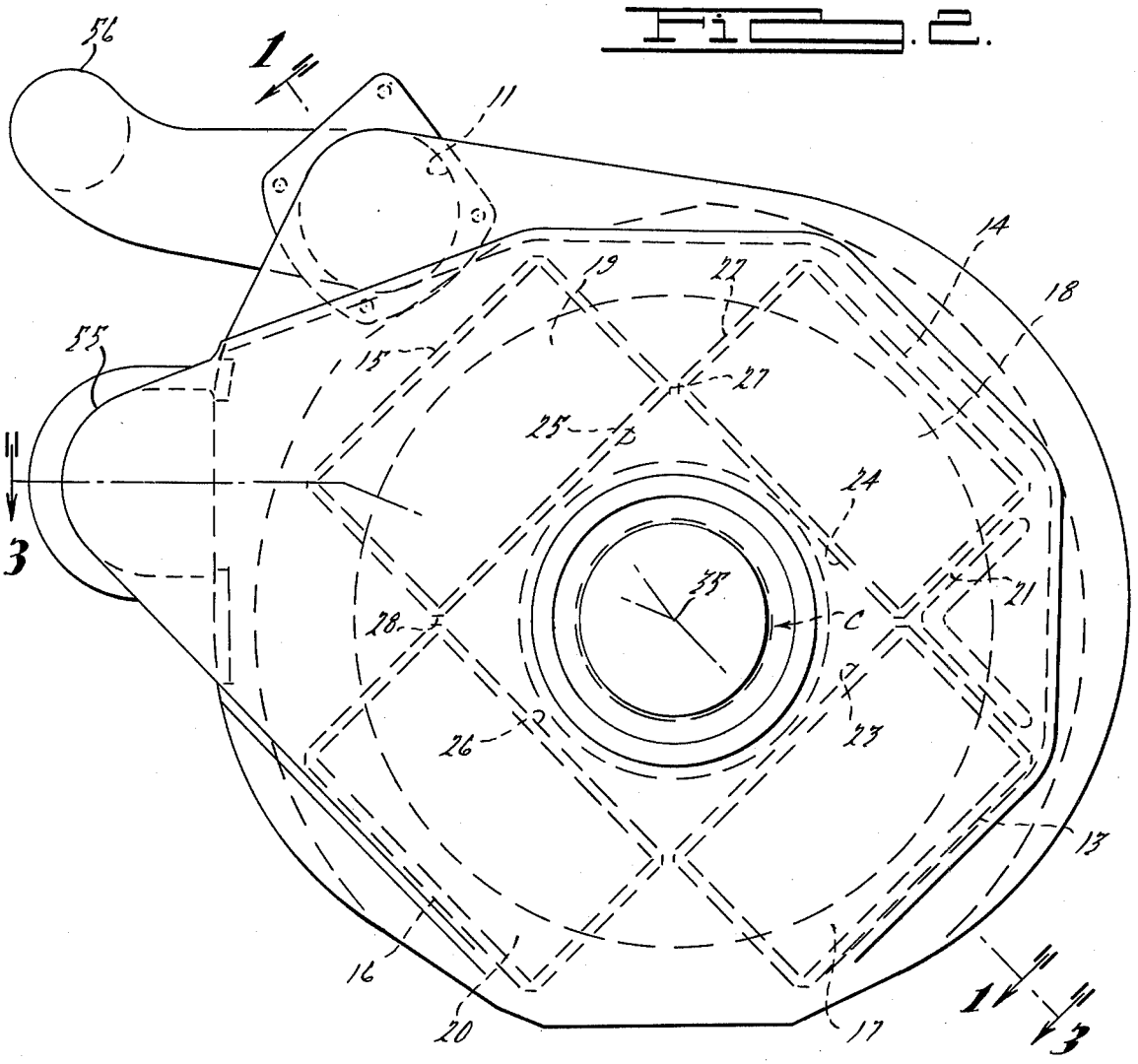
FIG. 2 is an end view of the Stirling engine of FIG. 1, showing the preheater construction of this invention in broken outline.
Figure 3:
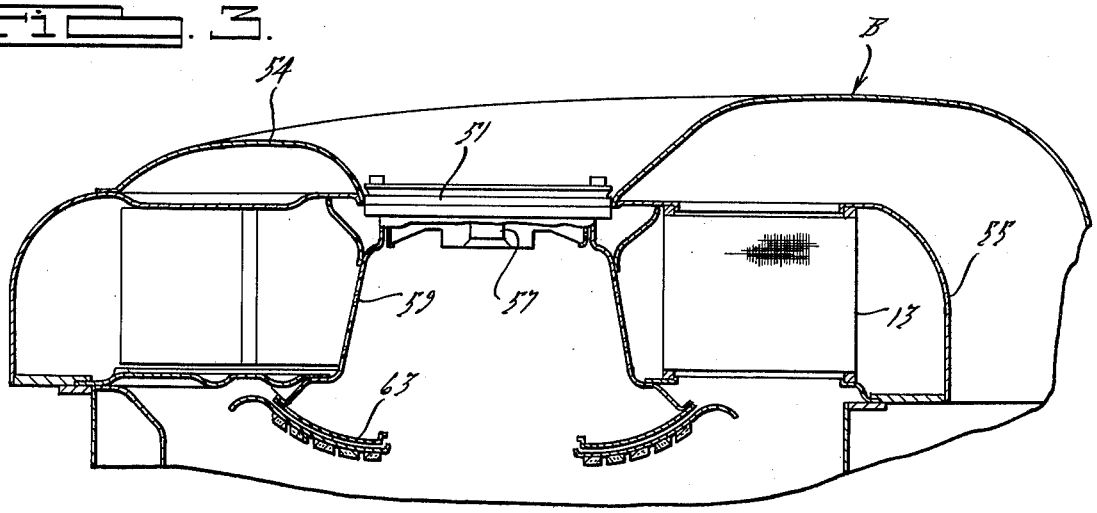
FIG. 3 is a sectional view taken substantially along line 3—3 of FIG. 2.

A preferred embodiment is illustrated in FIGS. 1-3 which, in its broad aspects, comprises an external heating circuit comprised of an induction means A and exhaust means B, a combustion unit C, a heating chamber D, and an annularly arranged heat exchange means E. The external heating circuit is in continuous operation during engine use. Heat generated by the external heating circuit is transferred to a closed working fluid system F which is cycled to promote work on a drive means by transfer of thermal energy.

The induction means A normally receives a supply of air which is positively moved by way of a blower (not shown) in a passage 56 (see FIG. 2), the blower receiving ambient air typically at a 100° F temperature or below. By virtue of the air compression imposed by the blower, the temperature of the air supply is raised to about 150° F; if exhaust gas recirculation is employed, it is usually blended with the incoming air to raise the inducted air to approximately a 270° F temperature, the temperature of the recirculated exhaust gas being about 640° F. Typical mass flows and temperature conditions for the external heating circuit at various stations identified in FIG. 1, would be as follows:

| Location | 4000 r.p.m. (Prior Art) m $\frac{LB}{HR}$ | t° F | p-psi |
|---|---|---|---|
| 1 | 2300 | 270 | 17 |
| 2 | 2300 | 270 | 17 |

-continued

| Location | 4000 r.p.m. (Prior Art) m $\frac{LB}{HR}$ | t° F | p-psi |
|---|---|---|---|
| 3 | 2300 | 1620 | 16 |
| 4 | 2400 | 3500 | 15 |
| 5 | 2400 | 1880 | 15 |
| 6 | 2400 | 1880 | 15 |
| 7 | 2400 | 640 | 14 |

Sheet metal shrouding 10 and conduit elements 11 may be employed to construct the induction means. One element of the shrouding is an annular bowl 12 which acts as an elbow to turn the inducted air supply to enter the flat outwardly facing surfaces 13, 14, 15 and 16 of each respective heat exchange module 17, 18, 19 and 20 (see FIG. 2). Inducted air is circulated around the entire heat exchange means E by virtue of the annular shroud 12, but air enters only each of the outer faces of the heat exchange modules because of closed faces at the sides 21 and 22 of each of the modules. The side faces of each module are closed by suitable ceramic infiltration or solid cast wall fused thereagainst as a closure.

Each heat exchange module is comprised totally of a ceramic matrix formed as a cubical and arranged with the inner most flat faces 23, 24, 25 and 26 forming an annular configuration or closed cylinder about the burner unit by having their respective inner edges 27 and 28 in contiguous contact. Each matrix is constructed of a ceramic material which is adapted for strength and stability at temperature conditions of 2000° F; sufficient strength for heat exchange purposes must be about 200 psi. A ceramic material meeting the above needs may be typically comprised of Magnesium Alumina Silicate or Lithium Alumina Silicate.

The modules are each formed of discrete layers of first passages (such as 29–31) interleaved with discrete layers of second passages (such as 32–34), the first passages being arranged to direct flow at right angles to the flow passing through said second passages. In other words, the second flow for exhaust is permitted in an axially direction (with reference to axis 35 of the burner unit) while the first flow for induction is permitted in a transverse axial direction. The modules are formed totally of ceramic material with no metallic elements, and upon completion, they form a honeycomb construction.

A typical method for constructing such ceramic modules is as follows:

1. Select a suitable ceramic material; typically Lithium Alumina Silicate, it is formed as a slurry mixed with resins to render a material having a consistency similar to a gum or other soft solid plastic material.

2. The soft solid material is formed into thin sheets and cut to specific cross-sectional dimensions equivalent to the cross-section of the module.

3. Each of the thin sheets are then passed through a continuous extruding device so as to form a plurality of precisely spaced and precisely determined fins 36 extending from the plane of the thin sheet serving as a wall 37. This step is equivalent to passing a corrugating roll over the thin sheet to form the plurality of fins 36.

4. The extruded sheets are interleaved with alternating orientation of the fins of successive sheets with respect to axis 35 but having all fins extending to the same side. This will provide said alternating flow passages both in an axial and transverse axial direction. The thin sheets are then held in a fixture while subjected to a sintering temperature sufficient to vaporize the resin in said soft ceramic solid and to ceramically bond the ends of the fins to the next adjacent sheet wall 37.

A typical module for purposes of defining a four-module annular preheater construction, may be approximately 4 inches in width, 5 inches in height and 8 inches in length. The fin height 38, fin pitch 39 and wall thickness 40 are of particular importance in the control of open flow area through the ceramic matrix. It has been found that to obtain a worthwhile pressure drop through the preheater matrix, the fin pitch to fin height should be maintained in a ratio between 1:1 and 2:1. The particular ratio selected in this range is dependent upon the total size allocated for the preheater by the design of the engine and general engine compartment space requirements. To obtain a pressure drop at full power conditions for a Stirling cycle engine, 47 centimeters of water is required as a design parameter. This necessitates at least 450 openings per square inch, and requires a fin height of approximately 0.024 inches, a fin wall and sheet wall thickness of 0.005 inch and a fin pitch of 1:1 which converts to a fin spacing 39 of about 0.029 inch. If reduced pressure drop is to be required then a 2:1 ratio for the fin pitch to fin height can be utilized.

It is important that the inner faces 23, 24, 25 and 26 of each of the ceramic preheater modules be arranged so that corner seal strips can be placed at the four inner edges (such as 27 and 28) in order to form a closed cylinder. Static seal strips (41, 42, 43, 44) are also placed at the top and bottom eight edges of each cubical module. Such seals are of a low cost design formed principally of ceramic material, such as Alumina and Silica Oxide. A preferable ceramic seal construction comprises a ceramic core 46 fabricated by weaving, the core is fitted within a folded thin strip of stainless steel foil 47 providing top and bottom protection. The foil encased ceramic string is then layed along the edges, such as at locations in FIG. 1, and held in place by slight compression imposed by the sheet metal shrouding 48 forming the fluid tight connections such as for the intake and exhaust passages as well as connections to the burner unit and heating chamber. The static or mechanical contact made with the preheater matrix is only along lines or narrow zones; all other faces of the matrix are exposed to the ducting.

The exhaust means B is comprised of a doughnut-shaped shroud 54 which collects gases exiting in an axial direction from the top of each of the modules. The inner periphery 50 of the exhaust shroud connects with housing elements 51 supporting the burner unit C and the outer periphery 52 of the exhaust shroud connects with the peripheral wall 53 of the intake shroud in a way to provide a flow separation therebetween. The exhaust shroud 54 collects the exhaust gases and carries them to an outlet passage 55 (see FIGS. 2 and 3).

The burner unit C is comprised of a sparking element and a fuel injection assembly 57 which in turn is enclosed in a sheet metal housing 58 extending through the central zone of the exhaust shroud 54. A burner unit apron 59 extends down in a hemi-spherical fashion and terminates adjacent the bottom inner periphery 60 of the preheater modules. The apron is perforated at 61 so as to allow the heated inducted air to pass therethrough and to flow to and through the perforated central combustion shell 62. The shell is open at its bottom for free flow of combustion gases into the heating chamber D.

The heating chamber is defined by a semi-spherical heat resistant wall 63 which is formed as a roof about the bottom opening of the burner unit shell. The side walls 64 of the heating chamber are formed also by heat resistant sheet metal which connects with the bottom outer periphery of the preheater matrix by way of flange 65.

Disposed within the heating chamber is a series of heater tube arrays F which connect with a series of heat chambers, regenerators and cooling spaces (all not shown) which together form a closed working fluid system which in part work the driven member of ghe engine. The array is formed of a series of cylindrical heat resistant tubes 66 which have one principal upward leg 66*a* and hairpin turn 66*b* which direct the tube along a horizontal leg 66*c* (the directions being taken with respect to FIG. 1). Suitable metallic fins 67 are attached about the horizontal legs 66*c* to increase heat exchange therebetween.

We claim:

1. In a Stirling engine having an external heating circuit in a closed working fluid system, a heater head assembly for transferring heat from said circuit to said closed working fluid system, comprising:

(a) an induction means for providing a positive supply of air to said assembly, (b) an exhaust means, (c) a combustion unit for adding fuel to said inducted supply of air and combusting said air mixture, (d) a heating chamber receiving the products of combustion from said combustion unit and within which is disposed a heater tube array for absorbing a predetermined heat content of said combustion products passing thereabout, and (e) heat exchange means comprising a fixed matrix annularly arranged about the axis of said heater tube array, said fixed matrix having wall defining layers of first passages interleaved with walls defining layers of second passages, said induction means being fluidly connected to one end of said first passages and the combustion unit being fluidly connected to the other end of said first passages, said exhaust means being fluidly connected to one end of said second passages and the heating chamber being fluidly connected to the other end of said second passages, the flow through said first passage is in a generally axial direction taken with respect to the axis of said combustion unit, and the flow through said second passage is in a transverse axial direction therein, the axial flow being substantially equal in volume to the transverse axial flow, said fixed matrix being formed substantially of a heat resisting ceramic material formed of discrete modules, each module having a cubical configuration with one flat face of each of said cubicals forming a closed cylinder about said burner unit whereby a uniform heat flux may be carried forth in said air flow to said combustion unit, said fluid connections between said intake and exhaust, and between the heating chamber and burner unit, are provided by ceramic seals disposed along the edges of said annularly arranged ceramic matrix, said matrix being formed as a plurality of cubicals, each of said cubicals said ceramic seals along the twelve edges thereof, the ceramic seals being comprised of a braided ceramic core encased within a thin distortable metal foil.

* * * * *